US005212966A

United States Patent [19]

Minami

[11] Patent Number: 5,212,966

[45] Date of Patent: May 25, 1993

[54] RESIN WRISTWATCH BAND HAVING FIRST AND SECOND MOLDED RESIN MEMBERS

[75] Inventor: Shunji Minami, Fussa, Japan

[73] Assignee: Casio Computer Co., Ltd., Tokyo, Japan

[21] Appl. No.: 882,441

[22] Filed: May 12, 1992

[30] Foreign Application Priority Data

May 15, 1991 [JP] Japan ..... 3-139737

[51] Int. Cl.[5] ..... A44C 5/00

[52] U.S. Cl. ..... 63/3; 224/178; 2/338

[58] Field of Search ..... 63/DIG. 3, 3; 224/164, 224/178, 179; 368/282, 281; 428/137, 193; 2/338

[56] References Cited

U.S. PATENT DOCUMENTS

| | | | |
|---|---|---|---|
| 3,362,595 | 1/1968 | Herzog | 224/178 |
| 3,378,181 | 4/1968 | Hirsh | 224/178 |
| 3,543,975 | 12/1970 | Bauer | 224/178 |
| 3,578,208 | 5/1971 | Herzog | 224/178 |

FOREIGN PATENT DOCUMENTS

| | | | |
|---|---|---|---|
| 241922 | 5/1965 | Fed. Rep. of Germany | 224/178 |
| 2630678 | 11/1989 | France | 224/178 |
| 2632570 | 12/1989 | France | 63/DIG. 3 |
| 56-21286 | 5/1981 | Japan . | |
| 2051409 | 3/1987 | Japan | 368/282 |
| 670745 | 7/1989 | Switzerland | 224/178 |
| 432568 | 7/1935 | United Kingdom | 224/178 |

*Primary Examiner*—Peter M. Cuomo
*Assistant Examiner*—F. Saether
*Attorney, Agent, or Firm*—Frishauf, Holtz, Goodman & Woodward

[57] ABSTRACT

A resin band is formed by molding a first resin member by injection molding to cover a net member excluding its periphery, and by molding a second resin member by injection molding to cover a periphery of the net member exposed from the first resin member. In the resin band formed in this manner, the adhesion strength of the first and second resin members is increased by the net member, and the resin band can be colored in two colors by changing the colors of the first and second resin members.

10 Claims, 7 Drawing Sheets

RESIN WRISTWATCH BAND HAVING FIRST AND SECOND MOLDED RESIN MEMBERS

BACKGROUND OF THE INVENTION

1. Field of the Invention

The present invention relates to a resin band made of a synthetic resin and used in an instrument such as a wristwatch, and a method of forming the same.

2. Description of the Related Art

Resin bands are used very often in, e.g., sports wristwatchs. A resin band, however, can cause cracking easily due to a degradation caused by long-term use and repeated bending Thus, a core member is provided in the resin band to reinforce it. Published Examined Japanese Utility Model Application No. 56-21286 discloses a conventional resin band having such a reinforcing structure. In the resin band of this publication, since the entire core member is covered with a single resin, the surface of the resin band is flat to provide a monotonous outer appearance, resulting in an unpreferable design. Also, since the color of the band is that of the resin, the resin band does not have color variations and thus lacks a variety of choices. In order to color a band in two different colors or more, plating must be performed on the surface of the band, resulting in a cumbersome operation.

SUMMARY OF THE INVENTION

The present invention has been made in view of the conventional problems described above, and has as its object to provide a resin band having a high strength and a good design.

It is another object of the present invention to provide a resin band which can be colored in 2 colors or more.

It is still another object of the present invention to provide a method of easily forming such a resin band.

In order to achieve these objects, according to the present invention, there is provided a resin band comprising a first resin member formed to have a belt-like shape by injection molding, a second resin member formed around the first resin member by injection molding, and a net member disposed in the first and second resin members.

With this arrangement, in the resin band according to the present invention, the net member serves as a core member of the band to improve the entire strength of the band and to couple the first and second resin members. Therefore, the resultant resin band has a good design, and even if the first and second resin members do not have good welding performance, they can be firmly coupled to each other. Also, since a net member is disposed in the first and second resin members, the band can be imparted with a color.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
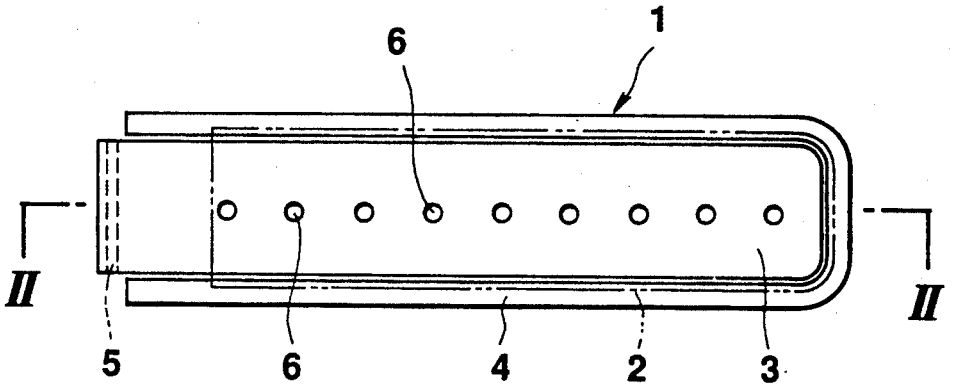
FIG. 1 is a plan view of a resin band according to the first embodiment of the present invention.
Figure 2:
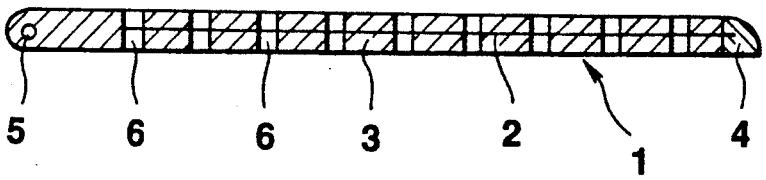
FIG. 2 is a sectional view taken along the line II—II of FIG. 1.

FIGS. 1 and 2 are plan and longitudinal sectional views, respectively, of a resin band 1 of a wristwatch according to the first embodiment of the present invention. The resin band 1 has a belt-like shape since its net member 2 is covered by first and second resin members 3 and 4. The net member 2 serves as the core member of the resin band 1 in order to increase the strength of the entire resin band 1. The net member 2 can be fabricated by an appropriate method, e.g., by knitting a yarn made of a synthetic resin such as nylon, Vinylon (tradename) or Tetron (tradename), by punching a thin plate made of such a synthetic resin, or by knitting a thin metal wire. In this embodiment, although the net member 2 reaches the distal end portion (right-side end portion) of the resin band 1, it does not reach the proximal end portion (left-side end portion) of the resin band 1, and is thus shorter than the entire length of the resin band 1. The proximal end portion of the resin band 1 to which the net member 2 does not reach serves as a portion to be mounted to an instrument case, e.g., a wristwatch case (not shown), and a through hole 5, in which a mount pin (not shown), e.g., a spring rod having two end portions fitted in the instrument case is inserted, is formed in it.

The first resin member 3 is formed by injection molding using a synthetic resin, e.g., polyurethane or vinyl chloride, to cover the net member 2 excluding its peripheral portion. More specifically, the width of the first resin member 3 is smaller than that of the net member 2, and the proximal end portion of the first resin member 3 extends beyond that of the net member 2. The through hole 5 extends through the proximal end portion of the first resin member 3. A plurality of band stopper holes 6 are formed in the first resin member 3 at a predetermined pitch along the central line of the longitudinal direction of the first resin member 3. The band stopper holes 6 extend through the thickness of the first resin member 3, and an adjusting pin (not shown) for adjusting the winding length of the band 1 is inserted in one of the holes 6 as required. Therefore, because of the presence of the band stopper holes 6, the winding length of the resin band 1 can be adjusted in accordance with the diameter of the wrist of the user. If a resin harder than polyurethane or vinyl chloride is used, cracking around the band stopper holes 6 can be effectively prevented.

The second resin member 4 is provided to extend along the periphery of the first resin member 3. The second resin member 4 is formed by injection molding after the first resin member 3 is formed by injection molding. The second resin member 4 covers the peripheral portion of the net member 2 exposed from the periphery of the first resin member 3. As a result, the net member 2 is not exposed, and the resin band 1 has a good outer appearance.

In this case, a resin softer than the first resin member 3 can be used to form the second resin member 4. If a material which is the same as or similar to that of the first resin member 3 is used to form the second resin member 4, the members 3 and 4 become compatible to improve the adhesion properties.

In the resin band 1 according to the first embodiment of the present invention, since the net member 2 serving as the core member is disposed in the first and second resin members 3 and 4, the band can have good durability and a high strength. Since the through hole 5 for the mount pin is formed in the proximal end portion of the first resin member 3, no extra mount member for mounting the resin band 1 on an instrument case is needed, facilitating formation of the resin band 1. Resins having different colors can be used to respectively form the first and second resin members 3 and 4, so that the resin band 1 can have at least two colors, thereby improving the outer appearance. This coloring is performed by injection molding of the first and second resin members 3 and 4. Since extra plating is not needed, the coloring process is simplified.

A method of forming the resin band 1 according to the first embodiment of the present invention will be described with reference to FIGS. 3 to 8.

Figure 3:
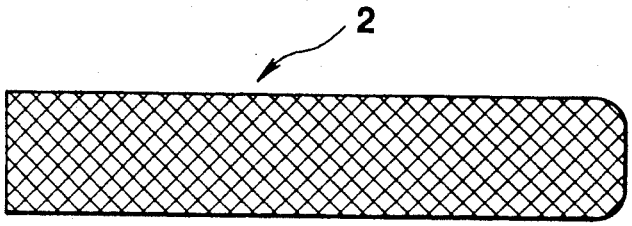
FIG. 3 is a plan view of a net member used in the first embodiment of the present invention.
Figure 4:
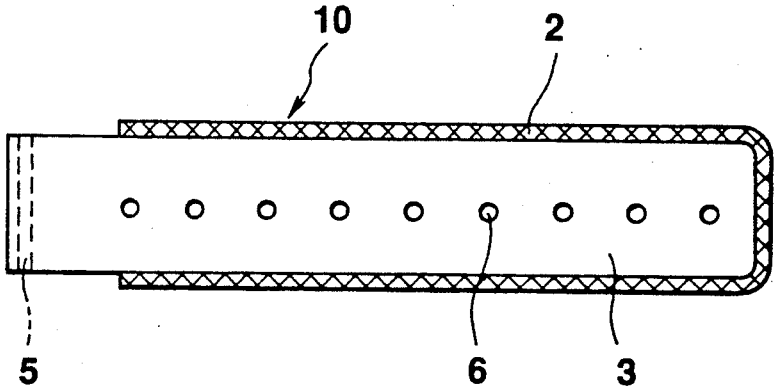
FIG. 4 is a plan view of a primary molded body during forming a resin band in accordance with a forming method of the present invention.
Figure 5:
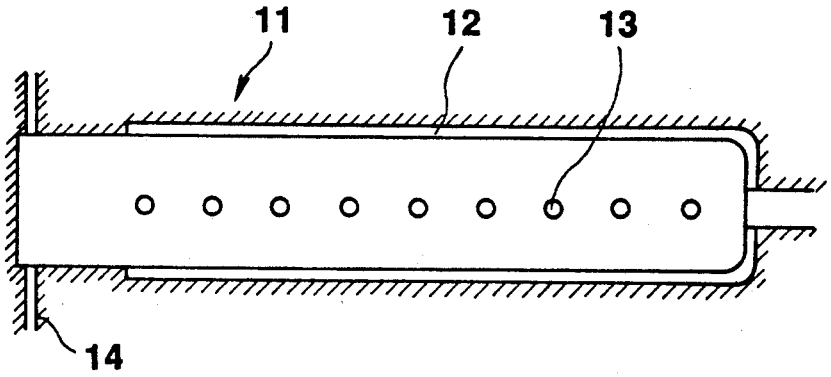
FIG. 5 is a plan view of a lower mold for primary molding used for forming the primary molded body.
Figure 6:
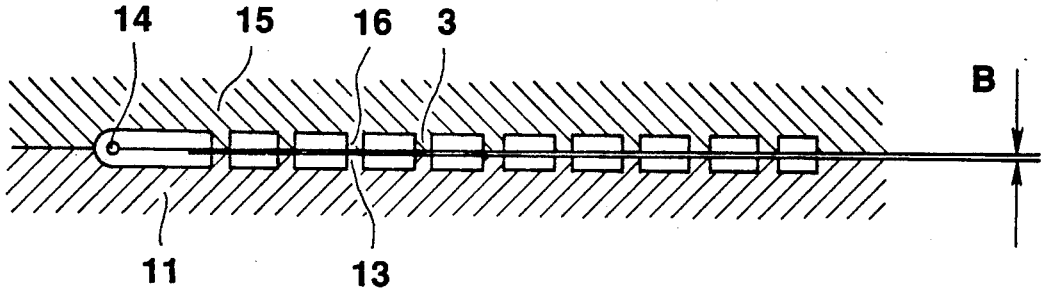
FIG. 6 is a longitudinal sectional view of the lower mold and an upper mold for primary molding shown in FIG. 5.

In the primary molding process, the net member 2 shown in FIG. 3 is inserted in a mold, and the first resin member 3 is formed in the mold by injecting a resin for the first resin member 3. FIG. 4 shows a primary molded body 10 obtained by this primary molding process. The periphery of the net member 2 excluding its proximal end portion exposes from the first resin member 3, and the plurality of band stopper holes 6 are formed in the first resin member 3. FIG. 5 is a plan view of a lower mold 11 of the molds used for the primary molding, and FIG. 6 is a longitudinal sectional view of the lower mold 11 and an upper mold 15. A set portion 12 to place the periphery of the net member 2 thereon is formed in the periphery of the lower mold 11 shown in FIG. 5, and a plurality of projections 13 corresponding to the plurality of band stopper holes 6 are formed in the lower mold 11 along the central line of the longitudinal direction. In order to form the through hole 5 for the mount pin in the first resin member 3, a pin-shaped telescopic element 14 is provided in the proximal end portion of the cavity of the lower mold 11 to extend in the direction of the width of the lower mold 11. FIG. 6 shows a state in which the lower mold 11 and the upper mold 15 are closed. Projections 1 corresponding to the projections 13 of the lower mold 11 are formed in the upper mold 15. The periphery of the net member 2 is clamped on the set portion 12 on the peripheries of the lower and upper molds 11 and 15, and the first resin member 3 is formed in this state by injecting a resin for the first resin member. At this time, a relationship $B \leqq A$ where A is the thickness of the net member 2 and B (see FIG. 6) is the distance between the lower and upper molds 11 and 15 clamping the net member 2 is satisfied. This relationship is maintained by the set portion 12 and the projections 13 and 14.

When the molds having this structure are used, the primary molded body 10 shown in FIG. 4 can satisfactorily be obtained by injection molding.

Figure 7:
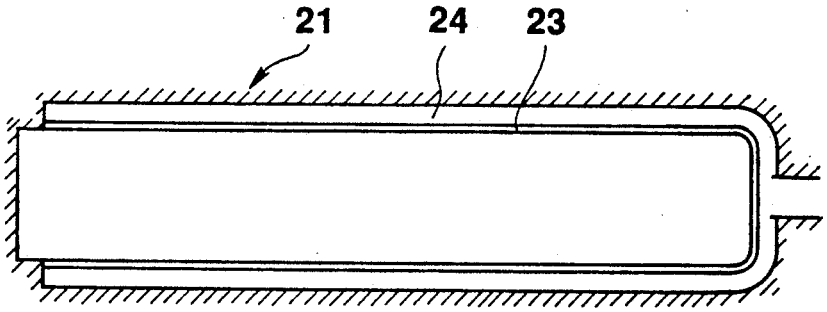
FIG. 7 is a plan view of a lower mold for secondary molding used for forming the resin band in accordance with the forming method of the present invention.
Figure 8:
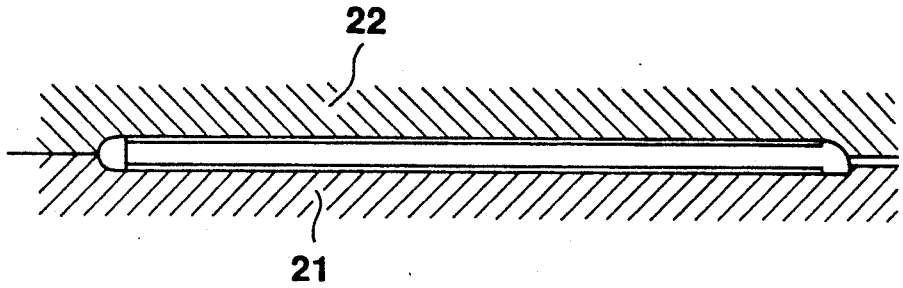
FIG. 8 is a longitudinal sectional view of the lower mold and an upper mold for secondary molding shown in FIG. 7.

FIG. 7 is a plan view of a lower mold 21 used for the secondary molding process, and FIG. 8 is a longitudinal sectional view of the lower mold 21 and an upper mold 22. A guide projection 23 having a shape to coincide with the outer shape of the first resin member 3 of the primary molded body 10 is formed in the lower mold 21 shown in FIG. 7. The outer surface of the guide projection 23 defines a cavity 24 for forming the second resin member 4. FIG. 8 shows a state in which the lower mold 21 and the upper mold 22 are clamped. When the primary molded body 10 is held in the lower and upper molds 21 and 22 and secondary injecting molding is performed, the resin band 1 shown in FIG. 1 is formed, and the periphery of the net member is completely covered by the second resin member 4. In primary molding and secondary molding, when a coating having adhesion properties is coated on the net member 2 and then injection molding is performed, the adhesion between the first and second resin members 3 and 4 can be increased.

Figure 9:
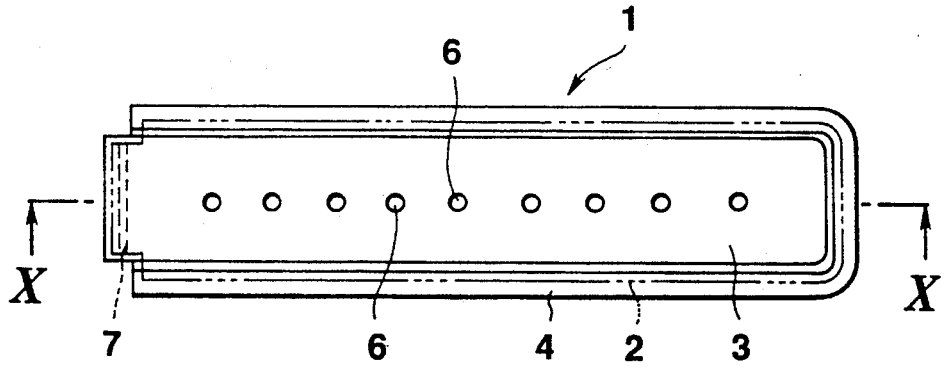
FIG. 9 is a plan view of a resin band according to the second embodiment of the present invention.
Figure 10:
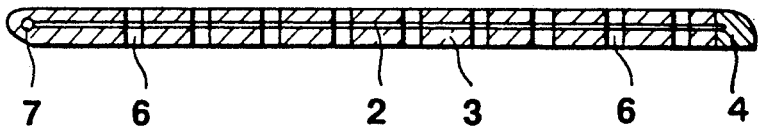
FIG. 10 is a sectional view taken along the line X—X of FIG. 9.

FIGS. 9 and 10 are plan and longitudinal sectional views, respectively, of the resin band 1 according to the second embodiment of the present invention. In the second embodiment as well, a first resin member 3 covers a net member 2 excluding its periphery, and a second resin member 4 covers the periphery of the net member 2 exposed from the first resin member 3. In the second embodiment, the net member 2 has substantially the same length as the entire length of the resin band 1, and a through hole 7 is defined in the proximal end portion of the resin band 1 serving as a mount portion on an instrument case (not shown) by the net member 2. The through hole 7 is formed by bending the net member 2, inserting a pin 31 in a hole inside the bent portion of the net member 2, and molding a resin by injection. A mount pin (not shown), e.g., a spring rod is inserted in the through hole 7 to mount the resin band 1 on an instrument case. When the through hole 7 is formed in the resin band 1 by the net member 2 in this manner, no extra mount member for mounting the resin band 1 on the instrument is needed, and formation of the resin band 1 is facilitated. Also, the mount strength of the resin band 1 on the instrument case can be increased, so that cracking may not occur in the mount portion or the resin band 1 may not be torn at the mount portion.

Figure 11:
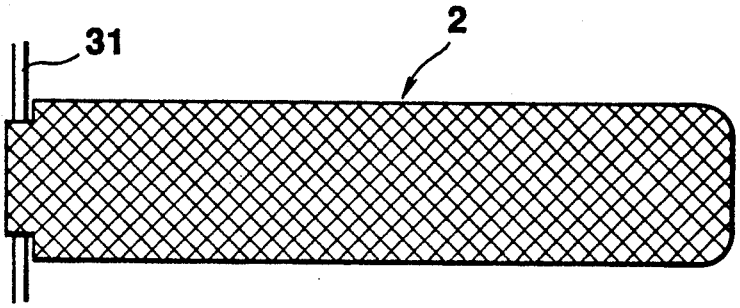
FIG. 11 is a plan view of a net member disposed in the resin band shown in FIG. 9.
Figure 12:
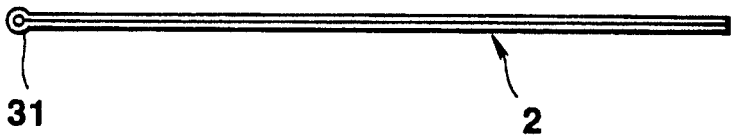
FIG. 12 is a side view of the net member shown in FIG. 11.
Figure 13:
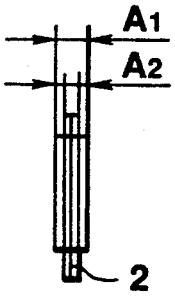
FIG. 13 is a front view of the net member shown in FIG. 11.
Figure 14:
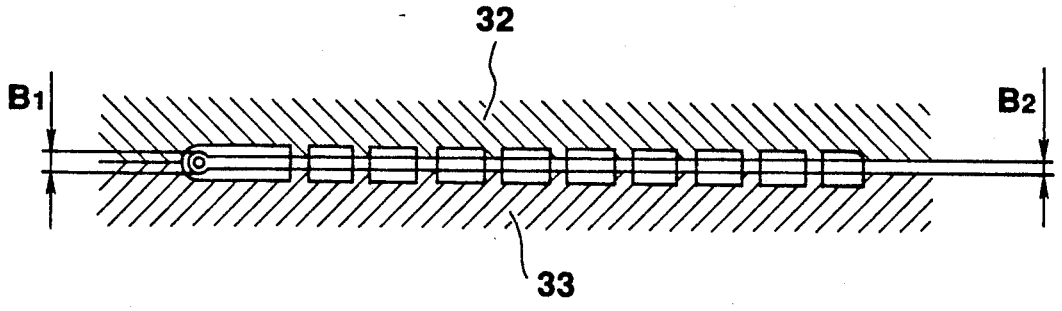
FIG. 14 is a longitudinal sectional view of a mold for primary molding used for forming the resin band shown in FIG. 9.
Figure 15:
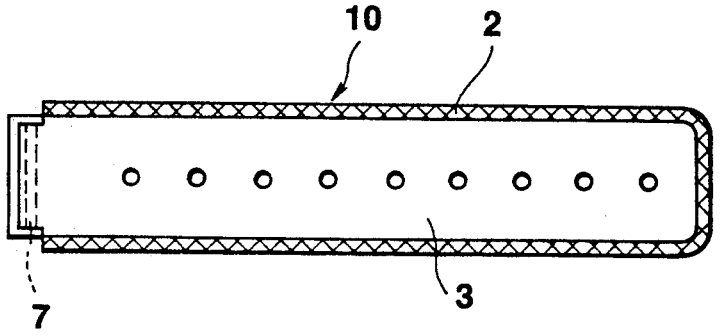
FIG. 15 is a plan view of a primary molded body formed by using the mold shown in FIG. 14.

A method of forming a resin band according to the second embodiment of the present invention will be described. FIGS. 11 to 13 show the net member 2 which is stacked by bending. The pin 31 is inserted in a hole inside the bent portion of the proximal end portion of the net member 2. In FIG. 11, the bent portion in which the pin 31 is inserted has a width smaller than other portions. However, this is to facilitate mounting of the resin band 1 on the instrument case, and the bent portion can have the same width as other portions. The net member 2 bent in this manner is disposed at a predetermined position in the molds for primary molding, and the first resin member 3 is formed in these molds by injecting a resin for the first resin member 3. FIG. 14 is a longitudinal sectional view of the molds for primary molding. The net member 2 is clamped between the upper and lower molds 32 and 33 so as to be bent. The gaps between the upper and lower molds at two end portions of the net member 2 and the thicknesses of the two end portions of the net member 2 are set to satisfy $A_1 \leqq B_1$ and $A_2 \leqq B_2$ where the upper and lower molds 32 and 33 at the two end portions of the net member 2 and $A_1$ and $A_2$ are the thicknesses of the net member 2 at the two end portions, as shown in FIG. 13. FIG. 15 shows a primary molded body 10 obtained by using these molds. The through hole 7 is formed on the proximal end portion of the molded body 10 to serve as a mount portion on an instrument when the pin is inserted in a hole inside the bent portion of the net member 2. Subsequently, the primary molded body 10 is disposed at a predetermined position in the molds for secondary molding shown in FIGS. 7 and 8, and the second resin member 4 is injection-molded in the molds to form the resin band 1 shown in FIG. 9.

Figure 16:
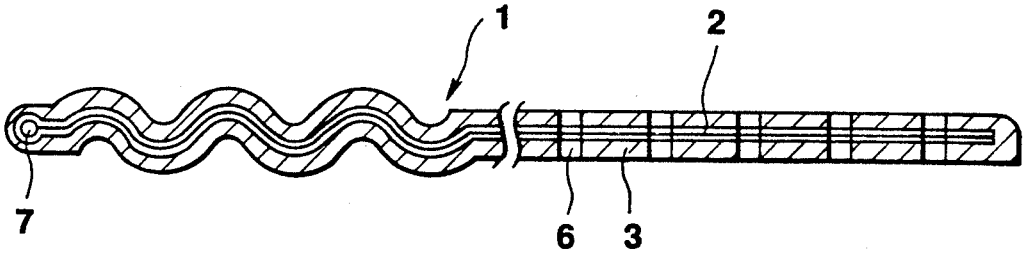
FIG. 16 is a longitudinal sectional view of the resin band according to the third embodiment of the present invention.

FIG. 16 shows the third embodiment of the present invention. A resin band 1 has a flat distal portion, and its portion from a through hole 7 to the first band stopper hole 6 is waved. This waved form makes the resin band 1 stretchable to a certain degree, increases its strength, and improves its durability.

Figure 17:
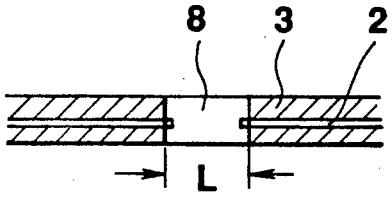
FIG. 17 is a longitudinal sectional view showing a process of forming a band stopper hole.
Figure 18:
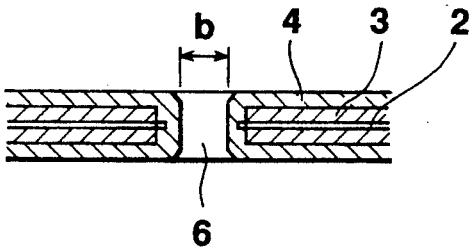
FIG. 18 is a longitudinal sectional view showing a final step in the process of forming the band stopper hole.

FIGS. 17 and 18 show another process of forming a band stopper hole 6.

According to this process, during primary molding to form a first resin member 3, a primary hole 8 having a diameter L larger than that of the band stopper hole 6 is formed (see FIG. 17). In this case, the diameter L of the primary hole 8 is set such that a net member 2 extends from the first resin member to be exposed in the primary hole 8. Subsequently, during secondary molding for molding a second resin member 4, the second resin member 4 covers the inner circumferential surface of the primary hole 8 (see FIG. 18). As a result, the net member 2 exposed in the primary hole 8 is covered by the second resin member 4, and the band stopper hole 6 having a diameter 1 ($1<L$) is defined by the inner circumferential surface of the second resin member 4 present in the primary hole 8. Since the net member 2 is disposed in the inner circumferential surface of the second resin member 4, the second resin member 4 of the band stopper hole 6 is reinforced, thereby preventing separation of the second resin member 4.

The present invention is not limited to the embodiments described above, and various modifications can be made. For example, if the first resin member is made of a hard resin and the second resin member is made of a soft resin, the rigidity around the through hole or the band stopper holes formed in the first resin member can be increased, and a comfortable wearing feeling can be obtained. The present invention can be used as a belt of a small electronic instrument, e.g., a portable video camera, or a belt of a bag or a cloth, e.g., pants or a skirt.

As has been described above, in the resin band according to the present invention, the net member serving as the core member is provided in the first and second resin members. Thus, the strengths of the first and second resin members are increased, and coloring in two colors can be easily performed. In the resin band according to the present invention, since the through hole for the mount pin is formed by the bent portion of the net member, the strength of the mount portion can be increased. Furthermore, according to the method of forming the resin band of the present invention, a resin band can be easily formed to have a high strength.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A resin wristwatch band comprising:

a first resin member formed by injection molding so as to have an elongated belt-like shape, a through hole being formed at one end portion of said first resin member to receive a mounting pin for mounting the band to a wristwatch case, said first resin member further having a plurality of band stopper holes formed therein;

a net member arranged embedded in said first resin member and having a peripheral edge portion projecting from a periphery of said first resin member; and a second resin member formed by injection molding, said second resin member covering said projecting peripheral edge portion of said net member and said second resin member firmly and hermetically joining the periphery of said first resin member, and wherein said second resin member is made of a softer resin material than said first resin member.

2. A resin wristwatch band according to claim 1, wherein said first and second resin members are made of materials having different colors.

3. A resin wristwatch band according to claim 1, wherein at least a part of said first resin member and at least a part of said net member inside first resin member are wave-shaped.

4. A resin wristwatch band according to claim 1, wherein said net member is bent to enclose said through hole.

5. A resin wristwatch band according to claim 4, wherein said through hole which receives a mounting pin is directed in a transverse direction of said elongated belt-like shaped first resin member.

6. A resin wristwatch band according to claim 1, wherein said net member is bent to enclose said through hole, and at least a part of said first resin member and at least a part of said net member inside first resin member are wave-shaped.

7. A resin wristwatch band according to claim 6, wherein said through hole which receives a mounting pin is directed in a transverse direction of said elongated belt-like shaped first resin member.

8. A resin wristwatch band according to claim 1, wherein said through hole which receives a mounting pin is directed in a transverse direction of said elongated belt-like shaped first resin member.

9. A resin wristwatch band according to claim 8, wherein said and stopper holes are formed substantially centrally along the longitudinal direction of said elongated belt-like first resin member and are spaced from each other along said longitudinal direction.

10. A resin wristwatch band according to claim 1, wherein said and stopper holes are formed substantially centrally along the longitudinal direction of said elongated belt-like first resin member and are spaced from each other along said longitudinal direction.

* * * * *